US006273971B1

(12) United States Patent
Kitano et al.

(10) Patent No.: US 6,273,971 B1
(45) Date of Patent: Aug. 14, 2001

(54) METHOD OF MANUFACTURING COLD ROLLED STEEL SHEET EXCELLENT IN RESISTANCE OF NATURAL AGING AND PANEL PROPERTIES

(75) Inventors: Fusato Kitano; Takeshi Fujita; Tadashi Inoue; Michihiro Hiasa, all of Tokyo; Takeo Ishii, Toyota, all of (JP)

(73) Assignee: NKK Corporation, Tokyo (JP)

( * ) Notice: Subject to any disclaimer, the term of this patent is extended or adjusted under 35 U.S.C. 154(b) by 0 days.

(21) Appl. No.: 09/446,702

(22) PCT Filed: Apr. 22, 1999

(86) PCT No.: PCT/JP99/02152

§ 371 Date: Apr. 10, 2000

§ 102(e) Date: Apr. 10, 2000

(87) PCT Pub. No.: WO99/55922

PCT Pub. Date: Nov. 4, 1999

(30) Foreign Application Priority Data

Apr. 27, 1998 (JP) ..... 10-116787

(51) Int. Cl.[7] ..... C21D 8/00

(52) U.S. Cl. ..... 148/507; 148/541; 148/547; 148/652; 148/661

(58) Field of Search ..... 148/507, 541, 148/547, 652, 661

(56) References Cited

U.S. PATENT DOCUMENTS 4,589,931 5/1986 Yasuda .

FOREIGN PATENT DOCUMENTS

510718 * 10/1992 (EP) ..... 148/652
0 691 415 1/1996 (EP) .
0 816 524 1/1998 (EP) .

OTHER PUBLICATIONS

Japanese Patent Application Kokoku Publication No. 60–46166 published Oct. 15, 1985.
Japanese Patent Application Kokai Publication No. 61–276928 published Dec. 6, 1986.
Patent Abstracts of Japan, vol. 011, No. 139, May 7, 1987 & JP 61 276928, Dec. 6, 1986.
Patent Abstracts of Japan, vol. 098, No. 006, Apr. 30, 1998 & JP 10 036916, Feb. 10, 1998.
Patent Abstracts of Japan, vol. 095, No. 005, Jun. 30, 1995 & JP 07 034138, Feb. 3, 1995.
Patent Abstracts of Japan, vol. 013, No. 042, Jan. 30, 1989 & JP 63 241122, Oct. 6, 1998.

* cited by examiner

*Primary Examiner*—Deborah Yee
(74) *Attorney, Agent, or Firm*—Nixon & Vanderhye

(57) ABSTRACT

The present invention provides a method of manufacturing a cold rolled steel sheet and a hot-dip zinc-coated steel sheet having excellent surface properties, an excellent resistance to natural aging and an excellent dent resistance of panel and, thus, adapted to the manufacture of steel sheet for outer panels of vehicles. The method comprises the steps of preparing steel consisting of 0.005 to 0.012% by weight of C, 0.01 to 0.4% by weight of Si, 0.15 to 1.0% by weight of Mn, 0.01 to 0.08% by weight of P, at most 0.02% by weight of S, 0.01 to 0.1% by weight of sol. Al, at most 0.004% by weight of N, and at least one element selected from the group consisting of 0.01 to 0.2% by weight of Nb and 0.04 to 0.1% by weight of Ti, and satisfying the condition 1.2≦(12/93) (Nb%/C%)+(12/48) (Ti*%/C%)≦2.5, applying a hot rolling and a cold rolling to the steel, soaking the cold rolled steel sheet at T(° C.) meeting a formula Ac3≧T(° C.)≧157log(X)+737, and cooling the steel sheet after the soaking step at a cooling rate meeting a formula R(° C./sec)≦−35+162/X. Ti*% (noted above)=Ti%−(48/14) N%−(48/32)S%. When Ti* in the above equation is not larger than 0, Ti* is regarded as 0.

13 Claims, 5 Drawing Sheets

$X=(12/93)(Nb/C)+(12/48)(Ti^*/C)$ ···Nb SERIES,Ti SERIES,Nb-Ti SERIES
$=(12/51)(V/C)$ ···V SERIES
$=(12/91)(Zr^*/C)$ ···Zr SERIES $Ti^*=Ti-(48/14)N-(48/32)S$, $Ti^*=0$ : WHERE $Ti^* \leqq 0$, $Ti^*=0$;
$Zr^*=Zr-(48/14)N-(48/32)S$, $Zr^*=0$ : WHERE $Zr^* \leqq 0$, $Zr^*=0$;

| ANNEALING 830°C COOLING RATE 15°C/sec | C (wt%) | X (EQUIVALENT RATIO TO C) | 2%BH (MPa) | ΔYPel (%) | KAIND OF STEEL | REMARKS |
|---|---|---|---|---|---|---|
| | 0.007 ~0.009 | 1.4 TO 1.6 | 0 TO 10 | 0 | ○ Nb SERIES | PRESENT INVENSION |
| | | | | | ○ Nb,B SERIES | |
| | | | | | △ Ti SERIES | |
| | | | | | □ Nb,Ti SERIES | |
| | | | 40 TO 50 | 1.5 TO 2.5 | ● V SERIES | COMPARATIVE EXAMPLE |
| | | | 7 TO 25 | 0 TO 0.3 | ▲ Zr SERIES | |
| | 0.0015 TO 0.004 | 0.5 | 30 TO 50 | 0.7 TO 2.5 | ■ Nb SERIES | |

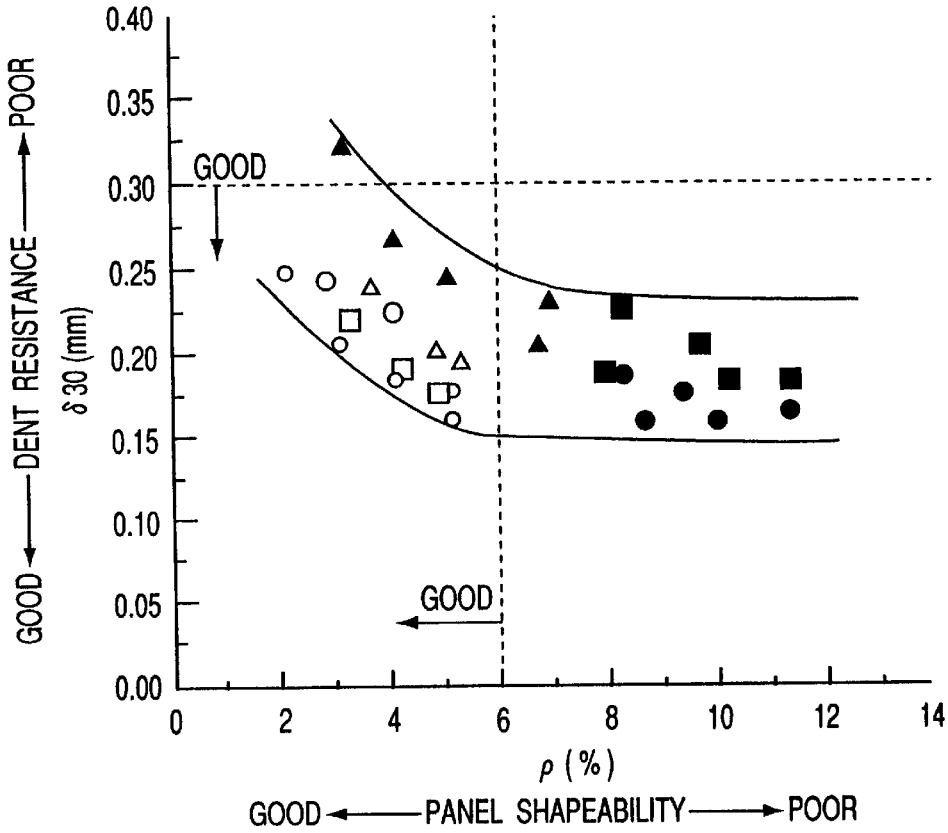

FIG. 3

Nb,Ti SERIES (C=0.008 TO 0.01 wt %)
COOLING RATE:20°C/sec

| | δ30 (mm) | ρ (%) | ΔYPel (%) | CLASSIFICATION |
|---|---|---|---|---|
| ○ | 0.19 TO 0.23 | 1 TO 4 | 0 | PRESENT INVENTION |
| ◷ | 0.19 TO 0.23 | 6 TO 8 | 0 | COMPARATIVE EXAMPLE |
| ◔ | 0.20 TO 0.24 | 8 TO 10 | 0 | |
| ◑ | 0.18 TO 0.21 | 8 TO 11 | 0.4 TO 0.8 | |

Nb SERIES (C=0.0085 TO 0.01wt%)
ANNEALING TEMPERATURE : 830°C

| | δ30 (mm) | ρ (%) | ΔYPel (%) | CLASSIFICATION |
|---|---|---|---|---|
| ○ | 0.18 TO 0.22 | 2 TO 4 | 0 | PRESENT INVENTION |
| ◷ | 0.18 TO 0.22 | 6 TO 8 | 0 | COMPARATIVE EXAMPLE |
| ◕ | 0.23 | 6 TO 8 | 0.4 | |
| ◑ | 0.17 TO 0.21 | 8 TO 10 | 0.4 TO 0.6 | |

METHOD OF MANUFACTURING COLD ROLLED STEEL SHEET EXCELLENT IN RESISTANCE OF NATURAL AGING AND PANEL PROPERTIES

TECHNICAL FIELD

The present invention relates to a method of manufacturing a cold rolled steel-sheet adapted for use in the preparation of vehicle outer panels such as doors, hoods, and fenders, particularly, to a method of manufacturing a cold rolled steel sheet excellent in its resistance to natural aging to suppress the yield elongation in tension, in its panel formability, in its panel shapeability, and in its dent resistance, i.e., resistance to a local concavity.

BACKGROUND ART

The steel used for preparation of vehicle outer panels such as doors, hoods, and fenders is required on one hand to be soft and exhibits an excellent formability before formation of the outer panel and is also required on the other hand to exhibit a high mechanical strength after the panel forming and painting so as to improve the dent resistance.

In recent years, a bake-hardenable (BH) cold rolled steel sheet has been developed. as a steel sheet meeting these requirements and is widely used nowadays. Particularly, vigorous studies are being made on a method of manufacturing a BH steel sheet having an excellent deep-drawability by annealing a cold rolled steel sheet prepared by adding carbonitriding elements such as Nb and Ti at an atomic ratio of 1 or less in terms of the carbon equivalent to an extra low carbon steel having the carbon content lowered to about 50 ppm.

For example, Japanese Patent Publication (Kokoku) No. 60-46166 discloses a technique of annealing an extra low carbon steel having Nb or Ti added thereto at a high temperature, i.e., about 900° C. The technique disclosed in this prior art is desirable in that, since the steel is annealed at a high temperature, it is possible to improve the bake-hardenability (BH), i.e., the degree of hardening of the steel that can be achieved when a strained steel is baked, and to improve an r-value providing an index of deep-drawability. However, this technique gives rise to a difficulty that the ferrite grains may be coarsened so as to deteriorate the surface state of the steel sheet. Also, since the steel sheet itself is softened, the mechanical strength of the steel sheet after the forming and painting is not satisfactory, even if high BH property is imparted to the steel sheet.

Japanese Patent Disclosure (Kokai) No. 61-276928 discloses a technique of manufacturing a BH steel sheet by annealing an extra low carbon steel having Nb added thereto at a temperature range of about 700 to 850° C. The annealing temperature disclosed in this prior art is relatively low, compared with that disclosed in JP '166 noted above. The low annealing temperature is desirable in respect of the surface and the yield strength of the steel sheet, but is not satisfactory for improving the r-value and BH property.

Further, although each of the prior arts exemplified above is intended to improve the BH property of a steel sheet, the improvement in the BH property promotes the natural aging. It follows that a yield point elongation is likely to be generated during the storage at room temperature, with the result that a stretcher strain may be generated in the panel forming. In order to prevent these difficulties, an improvement in the BH property is limited.

DISCLOSURE OF INVENTION

An object of the present invention is to provide a method of manufacturing a cold rolled steel sheet excellent in panel formability and dent resistance required for a steel sheet used as a vehicle outer panel while maintaining a resistance to natural aging.

Another object of the present invention is to provide a method of manufacturing a hot-dip zinc coated steel sheet excellent in panel formability and dent resistance required for a steel sheet used as a vehicle outer panel while maintaining a resistance to natural aging.

These objects can be achieved as follows:

1. A method of manufacturing a cold rolled steel sheet excellent in its resistance to natural aging and in panel properties, comprising steps of:

preparing steel consisting of 0.005 to 0.012% by weight of C, 0.01 to 0.4% by weight of Si, 0.15 to 1.0% by weight of Mn, 0.01 to 0.08% by weight of P, at most 0.02% by weight of S, 0.01 to 0.1% by weight of sol. Al, at most 0.004% by weight of N, and at least one element selected from the group consisting of 0.01 to 0.2% by weight of Nb and 0.04 to 0.1% by weight of Ti, X in formula (1) defined by C, Nb, and Ti contents falling within a range of between 1.2 and 2.5, i.e., $1.2 \leqq X \leqq 2.5$, and the balance of essentially Fe and unavoidable impurities:

$$X=(12/93)\,(Nb\%/C\%)+(12/48)\,(Ti^*\%/C\%) \quad (1)$$

where $Ti^*\%=Ti\%-(48/14)N\%-(48/32)S\%$ when Ti* in the above equation is not larger than 0, Ti* is regarded as 0;

melting the steel;

applying a hot rolling and a cold rolling to the molten steel;

soaking the cold rolled steel sheet at T(° C.) meeting a formula $Ac3 \geqq T(°\,C.) \geqq 157\log(X)+737$; and cooling the steel sheet after the soaking step at a cooling rate meeting a formula $R(°\,C./sec) \leqq -35+162/X$.

2. The method defined above, wherein the steel further contains 0.0002 to 0.002% by weight of B.

3. The method defined above, wherein the cold rolled steel has a yield point of 212 to 233 MPa, a 2% BH, i.e., degree of hardening achieved by baking after impartation of 2% strain, of 0 to 11 MPa, a residual depression 30 after application and, then, removal of 30 kgf of load of 0.18 to 0.25 mm, a spring back amount of 1 to 4%, and a restoration amount of yield point elongation ΔYPel after storage for 6 months at 25° C. of 0%.

4. The method defined above, wherein the cold rolled steel has a yield point of 220 to 231 MPa, a 2% BH, i.e., degree of hardening achieved by baking after impartation of 2% strain, of 5 to 14 MPa, a residual depression 30 after application and, then, removal of 30 kgf of load of 0.2 to 0.23 mm, a spring back amount of 4%, and a restoration amount of yield point elongation ΔYPel after storage for 6 months at 25° C. of 0%.

5. The method defined above, wherein the cold rolled steel has a yield point of 220 to 233 MPa, a 2% BH, i.e., degree of hardening achieved by baking after impartation of 2% strain, of 0 to 3 MPa, a residual depression 30 after application and, then, removal of 30 kgf of load of 0.21 to 0.25 mm, a spring back amount of 2 to 4%, and a restoration amount of yield point elongation ΔYPel after storage for 6 months at 25° C. of 0%.

6. The method of manufacturing a hot-dip zinc coated steel sheet being excellent in resistance to natural aging and in panel properties, further comprising the step of galvanizing the cold rolled steel sheet.

According to the present invention, it is possible to manufacture stably a cold rolled steel sheet and a molten zinc-coated steel sheet excellent in resistance to natural aging, in dent resistance after the panel forming, and in shapeability required for a steel sheet used as a vehicle outer panel by controlling appropriately the steel chemical composition, and annealing conditions such as the annealing temperature and cooling rate. Therefore, the present invention is highly valuable in the steel industry and the vehicle industry.

BRIEF DESCRIPTION OF DRAWINGS

FIG. 3 shows the results of evaluating the dent resistance and the panel shapeability of steels differing from each other in components;

BEST MODE OF CARRYING OUT THE INVENTION

Figure 1:
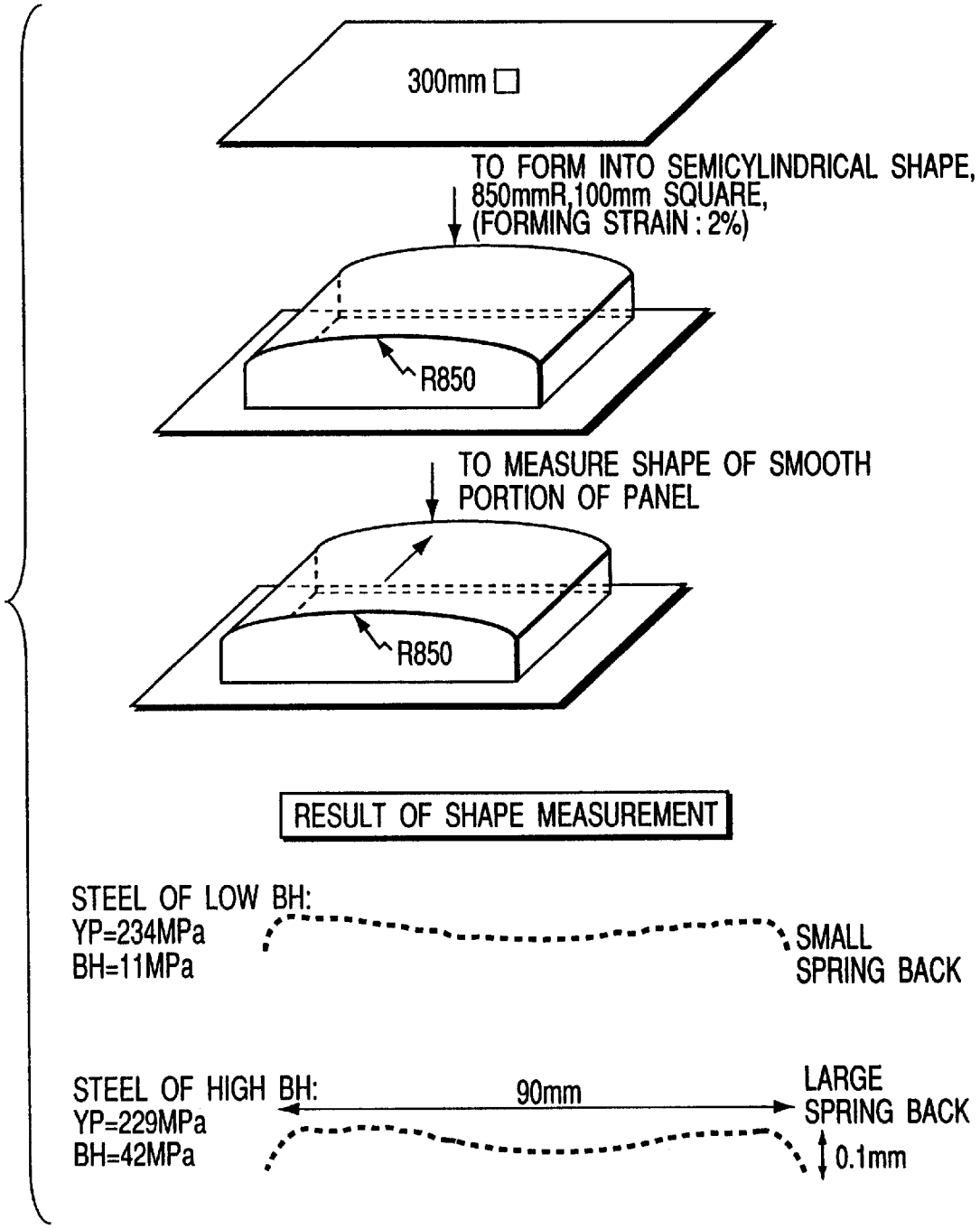
FIG. 1 shows the changes in the panel shape of the materials of the present invention differing from each other in the 2% BH amount.

The present inventors have newly found that the panel properties of a steel sheet originally having a high BH property are markedly deteriorated, compared with those of a steel sheet having a low BH property, unlike the natural aging as described above. Specifically, the present inventors formed a steel sheet sized at 300 mm×300 mm into a semicylinder with 850 mm R and 100 mm square with a forming strain of 2% so as to measure the shape in the smooth portion of the panel. It has been found that steel (2) having high BH property is large in spring back; whereas, steel (1) having low BH property is small in spring back. This implies that, even if a steel sheet meets the dent resistance and has BH property in which the natural aging does not pose a problem, it is difficult for the steel sheet to satisfy the shapeability in the panel forming.

Such being the situation, the present inventors took the position that, in order to manufacture a steel sheet excellent in resistance to natural aging and in panel shapeability, it would be important to lower the BH property in contrast to the BH property-based material design in the prior art. Also, as a measure for improving the dent resistance, the present inventors paid attention to the work-hardening property in a low strain region imparted in the panel forming in place of the index of the BH property, and continued an extensive research on the assumption that the material design for improving the work-hardening property would be effective for improving the dent resistance. As a result, it has been found that, among the steel strengthening mechanism, it is effective for improving the dent resistance to disperse, particularly, fine carbonitride particles affecting the work-hardening property into the matrix of the steel.

The present inventors have also found that a steel sheet satisfying both the resistance to natural aging and the panel properties can be obtained by controlling the amounts of C, Nb and Ti contained in the steel and forming carbonitride to fall within a predetermined range and by controlling the soaking temperature and the cooling rate after soaking to fall within predetermined ranges in annealing step after the hot rolling and the cold rolling, arriving at the present invention.

Let us describe the reasons for using additives of the steel, for specifying the limitation of the additive components and for specifying the limitation in the manufacturing conditions employed in the method of the present invention. In the following description, "%" represents "% by weight".

(1) Range of Additive Components:

C: 0.005 to 0.012%

Carbon is added in order to obtain carbonitride, which is formed together with Nb or Ti as well as N and contributes to improvement of the work-hardening property in the panel forming. For achieving the object, at least 0.005% of C is required. Also, if the carbon amount exceeds 0.012%, the steel sheet is rendered hard so as to deteriorate the panel shapeability. It follows that the carbon amount should fall within a range of between 0.005 and 0.012%.

Si: 0.01 to 0.4%

Silicon is effective for strengthening the steel. If the silicon amount is smaller than 0.01%, it is impossible to obtain a solid solution strengthening capability. On the other hand, if the silicon amount exceeds 0.4%, the formability of the steel is deteriorated. In addition, a hot-dipped zinc fails to be coated satisfactorily on the steel surface. It follows that the silicon amount should fall within a range of between 0.01 and 0.4%.

Mn: 0.15 to 1.0%

Manganese is added in order to solidify S that gives rise to the hot shortness of the steel in the form of MnS. If the Mn amount is smaller than 0.15%, the particular effect cannot be obtained. On the other hand, the particular effect is saturated, if the Mn amount exceeds 1.0%. It follows that the Mn amount should fall within a range of between 0.15 and 1.0%.

P: 0.01 to 0.08%

Phosphorus produces the most prominent solid solution strengthening capability. Thus, at least 0.01% of P is required. However, if the P amount exceeds 0.08%, the ductility of the steel markedly deteriorates. In addition, a good alloying cannot be performed during the treatment of galvanizing. It follows that the P amount should fall within a range of between 0.01 and 0.08%.

S: ≦0.02%

Sulfur brings about a hot shortness and, thus, should be used in an amount of 0.02% or less.

Sol. Al: 0.01 to 0.1%

Sol. Al is added for deoxidation of steel and for fixing of solute N in the steel. To achieve the purpose, it is necessary to add at least 0.01% of sol. Al. If the addition amount exceeds 0.1%, however, the surface properties of the steel sheet are markedly lowered. It follows that the amount of sol. Al should fall within a range of between 0.01% and 0.1%.

N: ≦0.004%

Nitrogen is immobilized in the form of AlN. If the amount of N exceeds 0.004%, however, the ductility of the steel sheet may be impaired by AlN. In addition, solute N in the steel may promote the natural aging of the steel sheet. It follows that the amount of N should be not larger than 0.004%, preferably not larger than 0.003%.

At least one element selected from the group consisting of Nb and Ti.

Nb: 0.01 to 0.2%

Niobium is added in order to form carbonitride contributing to the work-hardening property in the step of forming a panel. If the addition amount is less than 0.01%, a desired effect cannot be obtained, failing to improve sufficiently the dent resistance. On the other hand, if the addition amount exceeds 0.2%, the steel sheet is rendered hard. In this case, the panel shapeability is deteriorated, though the dent resistance is improved. It follows that the Nb addition amount should between 0.01 and 0.2%, preferably between 0.023 and 0.1%.

Ti: 0.04 to 0.1%

Like niobium, titanium serves to form carbonitride improving the work-hardening in a low strain region in the panel forming step. If the Ti addition amount is smaller than 0.04%, a sufficient effect of forming carbonitride cannot be obtained. If the addition amount exceeds 0.1%, however, the yield strength of the steel sheet increases so as to deteriorate the panel shapeability. Further, the surface properties of the steel sheet after the treatment of galvanizing are markedly deteriorated. It follows that the addition amount of Ti should fall within a range of between 0.04 and 0.1%, preferably between 0.05 and 0.09%.

$1.2 \leqq X \leqq 2.5$ $$X=(12/93)\ (Nb\%/C\%)+(12/48)\ (Ti^*\%/C\%)$$

where $Ti^*\%=Ti\%-(48/14)N\%-(48/32)S\%$ when $Ti^*$ in the above equation is not larger than 0, $Ti^*$ is regarded as 0.

X is an index denoting the effect of improving the work-hardening properties produced by Nb, Ti-series carbonitride in the panel forming step.

If the value of X is smaller than 1.2, it is impossible to enable the Nb, Ti-series carbonitride to produce a sufficient effect of improving the work-hardening properties in the panel forming step. In addition, it is impossible to immobilize sufficiently the carbon in the steel in the form of carbonitride so as to bring about the BH property giving a detrimental effect to the panel shapeability. On the other hand, if the value of X exceeds 2.5, the yield strength of the steel sheet is increased so as to deteriorate the panel shapeability, though the dent resistance of the panel is increased. It follows that X should fall within a range of between 1.2 and 2.5, i.e., $1.2 \leqq X \leqq 2.5$, preferably between 1.3 and 2.2, i.e., $1.3 \leqq X \leqq 2.2$.

Among the various additive components used in the present invention, Nb and Ti are the most effective for improving both the panel shapeability and the dent resistance. In the case of using Zr or V, the resultant carbonitride fails to produce a satisfactory function.

FIG. 3 is a graph showing the panel shapeability on the abscissa and the dent resistance on the ordinate in respect of the Nb-series (○), Nb, B-series (○), Ti-series (Δ), Nb, Ti-series (□) of the present invention and comparative examples of V-series (●), Zr-series (▲), and Nb-series ($0.0015 \leqq C \leqq 0.004$, X=5) (■). As apparent from FIG. 3, any of the Nb-series, Nb, B-series, Ti-series and Nb, Ti-series specified in the present invention is satisfactory in each of the panel shapeability and the dent resistance. In the V-series, Zr-series and Nb-series of the comparative examples, however, it is impossible to satisfy both the panel shapeability and the dent resistance simultaneously, compared with the present invention.

Further, in order to improve the resistance to brittleness in second operation and the dent resistance of the panel, the steel of the present invention may also contain B in an amount given below:

B: 0.0002 to 0.002%

If boron is added, the ferrite grain boundary is strengthened and the ferrite microstructure is made finer. The strengthened grain boundary permits improving the resistance to the brittleness in secondary operation. On the other hand, the fine ferrite make it possible to ensure a yield strength of the steel sheet so as to improve the dent resistance of the panel. However, these effects cannot be obtained, if the boron addition amount is smaller than 0.0002%. Also, if the addition amount exceeds 0.002%, the steel sheet is markedly hardened. It follows that the boron addition amount should fall within a range of between 0.0002 and 0.002%, preferably between 0.0004 and 0.0008%.

A steel sheet of the present invention can be manufactured from the steel of the composition described above as follows.

(2) Steel Sheet Manufacturing Process

In the first step, a steel of the composition specified in the present invention is melted. In general, a converter method is employed for the melting, though an electric furnace method can also be employed. The resultant molten steel is continuously cast into a slab, followed by immediately applying a hot rolling to the cast slab. Alternatively, the cast slab is subjected to a heat treatment, followed by applying a hot rolling. It is desirable to carry out the hot rolling under the conditions that the finishing temperature is set at (Ar3−100)° C. or more, and the coiling temperature is set at 500 to 700° C. By setting the finishing temperature as noted above, the ferrite microstructure of the hot rolled steel sheet can be made finer. Also, by controlling the coiling temperature to fall within the range noted above, it is possible to control the type of the Nb-series or Ti-series carbonitride.

In the next step, the hot rolled steel sheet is subjected to an acid pickling and a cold rolling in accordance with the ordinary method, followed by a continuous annealing. In the continuous annealing step, the steel sheet is kept soaked at temperature T(° C.) meeting the condition given below, followed by being cooled at a cooling rate R(° C./sec) meeting the condition given below.

Specifically, the soaking temperature T(° C.) should fall within the range given below:

$$Ac3 \geqq T(^\circ C.) \geqq 157\log(X)+737$$

where X, which is a parameter defined by the addition amounts of C, Nb and Ti, is:

$$X=(12/93)\ (Nb\%/C\%)+(12/48)\ (Ti^*/C.)$$

where $Ti^*=Ti\%-(48/14)N\%-(48/32)S\%$, when $Ti^*$ in the above equation is not larger than 0, $Ti^*$ is regarded as 0.

If the soaking temperature T(° C.) is lower than the lower limit of 157log(X)+737 noted above, the steel sheet fails to be softened sufficiently in the annealing step, resulting in an increased deterioration of the panel shapeability derived from the high yield strength. On the other hand, if the soaking temperature T(° C.) exceeds the upper limit Ac3, dissolution of the carbonitride proceeds during the annealing process, with the result that the panel shapeability is deteriorated prominently in accordance with promotion of the BH property caused by an increase in the amount of solute carbon. It follows that the soaking temperature T(° C.) should meet the condition; $Ac3 \geqq T(^\circ C.) \geqq 157\log(X)+737$.

Figure 4:
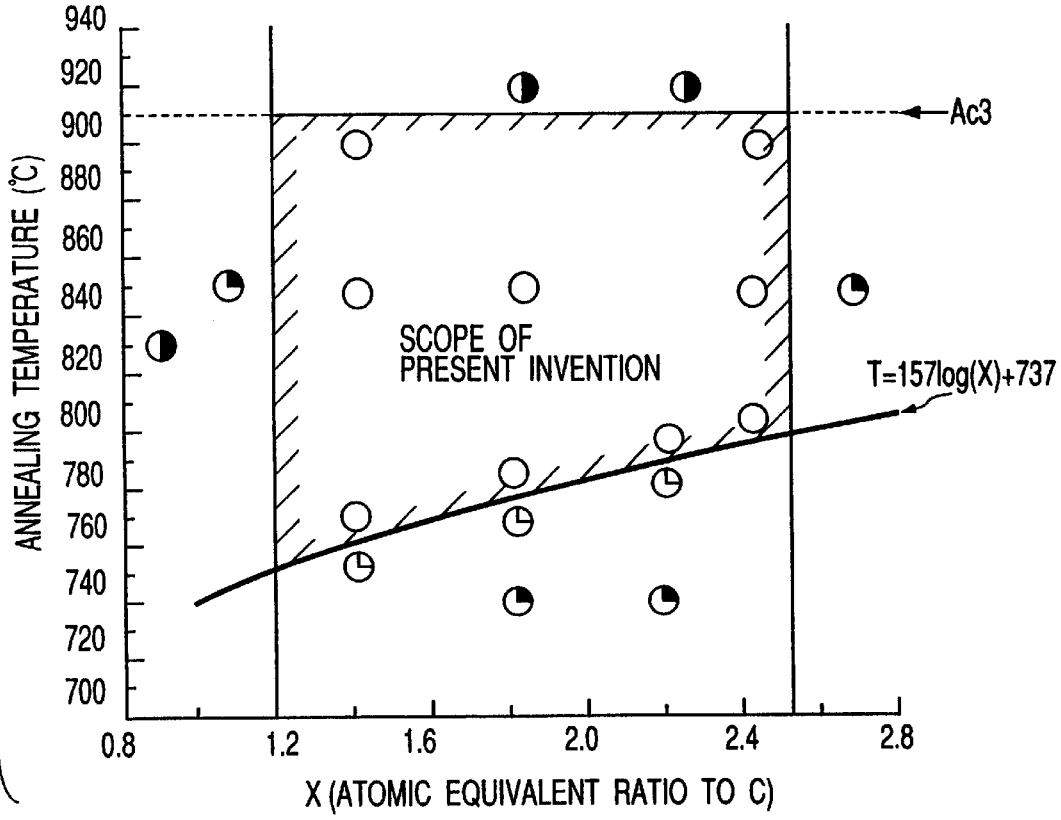
FIG. 4 is a graph showing the influences given by the annealing temperature and the components of the steel to the dent resistance, panel shapeability and resistance to natural aging.

FIG. 4 is a graph showing the panel shapeability and the dent resistance relative to the values of X and the annealing temperature T (° C.), covering the case where a Nb, Ti-series steel sheet of the present invention containing 0.008 to 0.01% by weight of carbon was cooled at a cooling rate of 20° C./sec. As is apparent from FIG. 4, the steel sheet of the present invention is satisfactory in both the panel shapeability and the dent resistance within the scope of the present invention.

In the present invention, the cooling rate R(° C./sec) should not be higher than −35+162/X, i.e., R(° C./sec)≦−35+162/X. If the cooling rate R(° C./sec) exceeds −35+162/X, carbonitride fails to be precipitated sufficiently in the cooling step after soaking, with the result that an excessively large amount of solute carbon tends to be present in the steel. In this case, deterioration of the panel shape caused by the promoted BH property unavoidably takes place in the panel forming. It follows that the upper limit of the cooling rate should be set at −35+162/X in the present invention.

Figure 5:
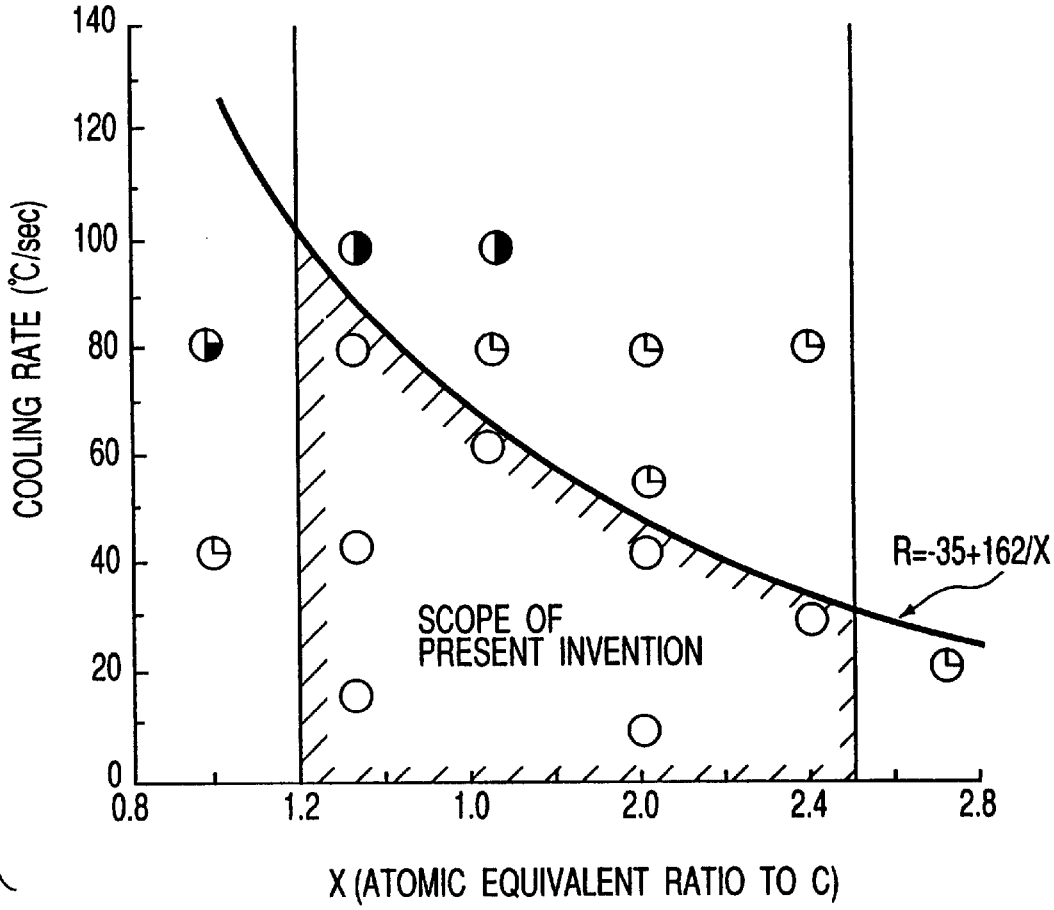
FIG. 5 is a graph showing the influences given by the cooling rate and the components of the steel to the dent resistance, the panel shapeability and the resistance to natural aging.

FIG. 5 is a graph showing the panel shapeability and the dent resistance relative to the values of X and the cooling rate, covering the case where a Nb-series steel sheet of the present invention containing 0.0085 to 0.01% by weight of carbon was annealed at a temperature of 830° C. As is apparent from FIG. 5, the steel sheet of the present invention is satisfactory in both the panel shapeability and the dent resistance where the cooling is performed within the range of cooling rate specified in the present invention.

The steel sheet thus obtained is coated with a hot-dipped zinc by the ordinary method. Incidentally, even if a surface treatment such as a zinc phosphate coating treatment or a conversion coating treatment is applied to the steel sheet, no problem is generated in the characteristics of the resultant steel sheet.

As described above, a cold rolled steel sheet and a hot-dip zinc coated steel sheet, which are excellent in resistance to the natural aging and in dent resistance of panel and, thus, suitable for use as outer panels of a vehicle, can be obtained in the present invention by subjecting the steel containing predetermined additive components and the balance of Fe and unavoidable impurities to the process defined in the present invention.

Some Examples of the present invention will now be described.

EXAMPLE 1

Each of steels having additive components as shown in Table 1 (Nos. 1 to 10 being the steels of the present invention, with Nos. 11 to 20 representing steels of comparative examples) was melted in a laboratory and, then, was continuously cast to prepare a slab having a thickness of 50 mm. The slab was rolled by a blooming mill to decrease the thickness to 30 mm, followed by being heated at a temperature of 1200° C. and subsequently being subjected to hot rolling. In the hot rolling, a rough rolling was applied first, followed by a finish rolling at 890° C. Further, a processing corresponding to a coiling process at a temperature of 620° C. was carried out so as to obtain a hot rolled sheet having a thickness of 3.2 mm. The hot rolled sheet thus obtained was pickled with an acid, followed by a cold rolling to decrease the thickness of the sheet to 0.70 mm. Then, a soaking treatment was applied to the sheet at 830° C. for 120 seconds, followed by cooling the sheet to about room temperature (about 30° C.) at an average cooling rate of 15° C./sec so as to obtain an annealed sheet. Further, a temper rolling was applied to the annealed sheet at an elongation of 1.0% so as to obtain samples to be tested. The mechanical properties, natural aging properties and panel properties of these samples were measured as follows.

A JIS No. 5 test piece was used for measuring each of the mechanical properties and the natural aging properties. The mechanical properties were measured by a tensile test specified in JIS Z 2241, and by examining the 2% BH amount in accordance with the method specified in JIS G 3135. For examining the 2% BH amount, a tensile strain of 2% is imparted to a parallel portion of a test piece. Then, a heat treatment is applied to the test piece at 170° C. for 20 minutes, followed by applying again a tensile test to the test piece. The 2% BH amount is calculated by an equation given below:

$$2\%\ BH=(A-B)/C$$

where, A denotes the yield load after the heat treatment, B denotes the load in the step of imparting a 2% strain before the heat treatment, and C denotes the cross sectional area in the parallel portion of the test piece before the test.

The natural aging properties were evaluated by the restoration amount (ΔYPel) of the yield elongation in tensile test of the steel sheet held at 25° C. for 6 months after the temper rolling. Where the restoration amount ΔYPel is 0%, the resistance to natural aging was evaluated as being satisfactory (marked ○). Where the restoration amount ΔYPel is 0 to 0.2%, the resistance to natural aging was evaluated as being somewhat deteriorated (marked "Δ"). Further, where the restoration amount ΔYPel is more than 0.2%, the resistance to natural aging was evaluated as being deteriorated (marked "x").

Figure 2:
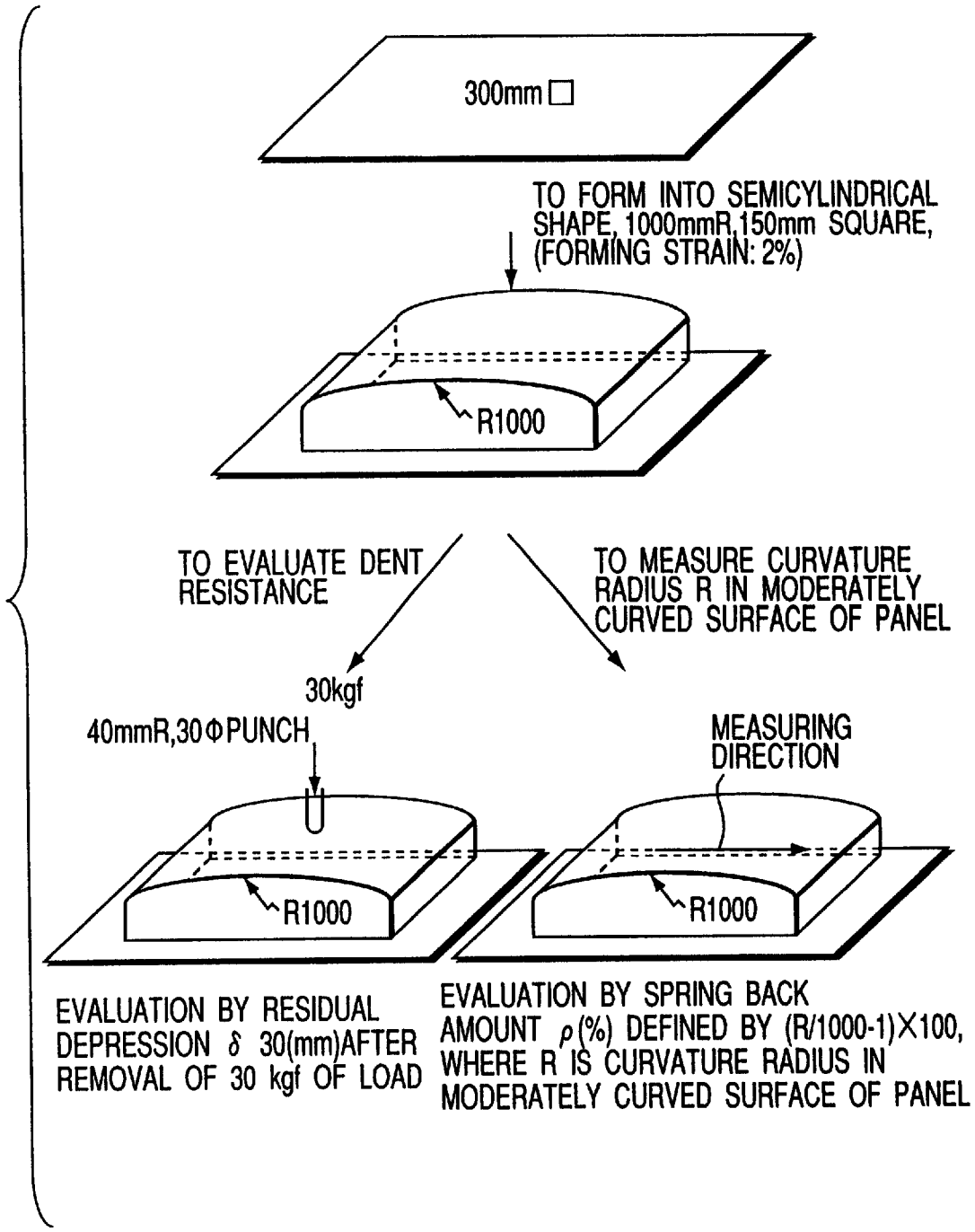
FIG. 2 shows the methods of evaluating the dent resistance and shapeability according to the present invention.

The panel properties such as the dent resistance and the shapeability were measured by using a panel prepared by shaping a flat sheet sized at 300 mm×300 mm into a semicylindrical form of 1000 mm R and 100 mm square, as shown in FIG. 2. For measuring the dent resistance, a load of 30 kgf was applied to the test panel, and the dent resistance was evaluated by 30 (mm), which is a residual depression after removal of the load. Where 30 was less than 0.3 mm, the dent resistance was evaluated as being satisfactory (marked "○"). Also, where 30 was 0.3 mm or more, the dent resistance was evaluated as being poor (marked "x"). Further, the shapeability was evaluated by a spring back amount (%) defined by (R'/R−1)×100, where R denotes the diameter of the press punch, and R' denotes the diameter of the panel. Where is less than 6%, the panel shapeability was evaluated as being satisfactory (marked "○"). Also, where is 6% or more, the panel shapeability was evaluated as being poor (marked "x").

Table 2 shows the results of evaluation of the mechanical properties and the panel properties. As shown in Table 2, the values of 30 were 0.18 mm to 0.25 mm in the steel samples Nos. 1 to 10 of the present invention, supporting a satisfactory dent resistance. Also, the yield point YP was somewhat low, i.e., 212 MPa to 233 MPa, and 2% BH amount was low, i.e., 0 to 11 MPa, the values of were 1% to 4% in the steel samples of the present invention, supporting a satisfactory panel shapeability. Further, ΔYPel was 0%, supporting that any of the steel samples of the present invention was excellent in the resistance to natural aging.

On the other hand, steel samples No. 11 to No. 20, which do not fall within the scope of the present invention, were not found to be satisfactory in the dent resistance, panel shapeability and resistance to natural aging. To be more specific, steel sample No. 11 had a large 2% BH amount, i.e., 35 MPa, leading to a high value of i.e., 8%, and a high value of ΔYPel, i.e., 0.7%. In other words, this steel sample was found to be unsatisfactory in the panel shapeability and the resistance to natural aging. Steel sample No. 12 was somewhat low in YP and 2% BH, supporting a satisfactory panel shapeability and a satisfactory resistance to natural aging. However, since the value of 30 was high, i.e., 0.32 mm, this sample was low in the dent resistance. Each of steel samples No. 13 and No. 14 was excellent in the dent resistance, but was poor in the panel shapeability and the resistance to natural aging. Each of steel samples No. 15 and No. 16 was satisfactory in the dent resistance and the resistance to natural aging, but was high in YP, leading to a poor panel shapeability. Each of steel samples No. 17 and No. 18 was somewhat high in YP, i.e., 238 MPa to 243 MPa, and high in 2% BH, i.e., 40 MPa to 50 MPa, indicating that these samples were poor in the panel shapeability and the resistance to natural aging. Further, steel sample No. 19 had a 30 value of 0.32 mm, indicating a poor dent resistance. Still further, steel sample No. 20 was found to be poor in each of the panel shapeability and the resistance to natural aging.

TABLE 1

| Steel sample No. | Chemical component (wt %) C | Si | Mn | P | S | sol. Al | N | Nb | Ti |
|---|---|---|---|---|---|---|---|---|---|
| 1 | 0.0065 | 0.07 | 0.75 | 0.01 | 0.008 | 0.077 | 0.0025 | 0.1 | tr. |
| 2 | 0.0072 | 0.02 | 0.38 | 0.04 | 0.015 | 0.058 | 0.0030 | 0.085 | tr. |
| 3 | 0.0091 | 0.15 | 0.65 | 0.02 | 0.01 | 0.045 | 0.0027 | 0.09 | tr. |
| 4 | 0.0088 | 0.02 | 0.3 | 0.04 | 0.013 | 0.06 | 0.0022 | 0.099 | tr. |
| 5 | 0.0063 | 0.3 | 0.83 | 0.01 | 0.01 | 0.02 | 0.0030 | tr. | 0.08 |
| 6 | 0.0085 | 0.01 | 0.2 | 0.07 | 0.009 | 0.037 | 0.0024 | tr. | 0.065 |
| 7 | 0.011 | 0.05 | 0.45 | 0.03 | 0.01 | 0.033 | 0.0022 | tr. | 0.083 |
| 8 | 0.0069 | 0.02 | 0.55 | 0.04 | 0.016 | 0.03 | 0.0025 | 0.023 | 0.067 |
| 9 | 0.0088 | 0.03 | 0.15 | 0.07 | 0.01 | 0.025 | 0.0030 | 0.034 | 0.071 |
| 10 | 0.010 | 0.01 | 0.47 | 0.035 | 0.009 | 0.042 | 0.0019 | 0.03 | 0.059 |
| 11 | 0.0038* | 0.02 | 0.68 | 0.05 | 0.011 | 0.048 | 0.0024 | 0.015 | tr. |
| 12 | 0.0033* | 0.15 | 0.71 | 0.04 | 0.009 | 0.062 | 0.0020 | 0.004 | tr. |
| 13 | 0.0069 | 0.05 | 0.55 | 0.03 | 0.012 | 0.051 | 0.0026 | 0.05 | tr. |
| 14 | 0.0086 | 0.043 | 0.37 | 0.02 | 0.015 | 0.055 | 0.0030 | 0.035 | 0.045 |
| 15 | 0.0070 | 0.23 | 0.15 | 0.02 | 0.013 | 0.063 | 0.0032 | tr. | 0.11* |
| 16 | 0.02* | 0.02 | 0.22 | 0.032 | 0.013 | 0.06 | 0.0025 | 0.04 | 0.15* |
| 17 | 0.0066 | 0.03 | 0.6 | 0.04 | 0.01 | 0.042 | 0.0022 | tr.* | tr.* |
| 18 | 0.0093 | 0.03 | 0.63 | 0.022 | 0.008 | 0.055 | 0.0028 | tr.* | tr.* |
| 19 | 0.0070 | 0.05 | 0.57 | 0.03 | 0.015 | 0.029 | 0.0023 | tr.* | tr.* |
| 20 | 0.010 | 0.02 | 0.43 | 0.026 | 0.01 | 0.032 | 0.0025 | tr.* | tr.* |

| Steel sample No. | V | Zr | B | (12/93) (Nb/C) + (12/48) (Ti*/C) | Remarks | Ar3 | Ac3 |
|---|---|---|---|---|---|---|---|
| 1 | tr. | tr. | tr. | 2.0 | Present invention | 893 | 892 |
| 2 | tr. | tr. | tr. | 1.5 | Present invention | 891 | 892 |
| 3 | tr. | tr. | tr. | 1.3 | Present invention | 886 | 895 |
| 4 | tr. | tr. | 0.0004 | 1.5 | Present invention | 884 | 890 |
| 5 | tr. | tr. | 0.0008 | 2.2 | Present invention | 890 | 905 |
| 6 | tr. | tr. | tr. | 1.3 | Present invention | 884 | 890 |
| 7 | tr. | tr. | tr. | 1.4 | Present invention | 880 | 889 |
| 8 | tr. | tr. | 0.0005 | 1.7 | Present invention | 884 | 892 |
| 9 | tr. | tr. | tr. | 1.8 | Present invention | 886 | 905 |
| 10 | tr. | tr. | tr. | 1.4 | Present invention | 880 | 888 |
| 11 | tr. | tr. | tr. | 0.5* | Comparative example | 897 | 898 |
| 12 | tr. | tr. | tr. | 1.6 | Comparative example | 903 | 905 |
| 13 | tr. | tr. | tr. | 0.9* | Comparative example | 890 | 895 |
| 14 | tr. | tr. | tr. | 0.9* | Comparative example | 882 | 893 |
| 15 | tr. | tr. | tr. | 2.8* | Comparative example | 890 | 900 |
| 16 | tr. | tr. | tr. | 1.8 | Comparative example | 875 | 880 |
| 17 | 0.04* | tr. | tr. | — | Comparative example | 890 | 895 |
| 18 | 0.06* | tr. | tr. | — | Comparative example | 882 | 896 |
| 19 | tr. | 0.13* | tr. | — | Comparative example | 888 | 895 |
| 20 | tr. | 0.12* | tr. | — | Comparative example | 880 | 887 |

*Outside the scope of present invention

TABLE 2

| Steel sample No. | Mechanical and panel properties YP (MPa) | 2% BH (MPa) | δ 30 (mm) | ρ (%) | ΔYPel (%) | Remarks |
|---|---|---|---|---|---|---|
| 1 | 215 | 0 | 0.25 (○) | 1 (○) | 0 (○) | Present invention |
| 2 | 219 | 6 | 0.24 (○) | 2 (○) | 0 (○) | Present invention |
| 3 | 220 | 10 | 0.22 (○) | 2 (○) | 0 (○) | Present invention |

TABLE 2-continued

| Steel sample No. | YP (MPa) | 2% BH (MPa) | δ 30 (mm) | ρ (%) | ΔYPel (%) | Remarks |
|---|---|---|---|---|---|---|
| | | | Mechanical and panel properties | | | |
| 4 | 225 | 11 | 0.18 (○) | 4 (○) | 0 (○) | Present invention |
| 5 | 212 | 0 | 0.22 (○) | 1 (○) | 0 (○) | Present invention |
| 6 | 220 | 6 | 0.24 (○) | 2 (○) | 0 (○) | Present invention |
| 7 | 232 | 6 | 0.18 (○) | 4 (○) | 0 (○) | Present invention |
| 8 | 220 | 0 | 0.21 (○) | 2 (○) | 0 (○) | Present invention |
| 9 | 230 | 0 | 0.20 (○) | 4 (○) | 0 (○) | Present invention |
| 10 | 233 | 4 | 0.19 (○) | 4 (○) | 0 (○) | Present invention |
| 11 | 230 | 35 | 0.23 (○) | 8 (×) | 0.7 (×) | Comparative example |
| 12 | 212 | 4 | 0.32 (×) | 1 (○) | 0 (○) | Comparative example |
| 13 | 237 | 30 | 0.18 (○) | 8 (×) | 0.8 (×) | Comparative example |
| 14 | 239 | 31 | 0.17 (○) | 9 (×) | 0.9 (×) | Comparative example |
| 15 | 249 | 0 | 0.17 (○) | 8 (×) | 0 (○) | Comparative example |
| 16 | 256 | 0 | 0.16 (○) | 10 (×) | 0 (○) | Comparative example |
| 17 | 238 | 40 | 0.17 (○) | 11 (×) | 1.9 (×) | Comparative example |
| 18 | 243 | 50 | 0.16 (○) | 11 (×) | 2.2 (×) | Comparative example |
| 19 | 227 | 7 | 0.32 (×) | 3 (○) | 0 (○) | Comparative example |
| 20 | 232 | 20 | 0.27 (○) | 6 (×) | 0.15 (Δ) | Comparative example |

EXAMPLE 2

Steel having a chemical composition equal to that of steel sample No. 3 or No. 9 shown in Table 1 was melted in a laboratory, followed by being casted to prepare a slab having a thickness of 60 mm. The resultant slab was subjected to a blooming rolling, followed by immediately applying a hot rolling to the slab without applying a heat treatment. In hot rolling, a finish rolling was applied at 900° C. after a rough rolling, followed by applying a coiling treatment at 600° C. so as to obtain a hot rolled sheet having a thickness of 3.0 mm. The resultant hot rolled sheet was rolled at room temperature to decrease the thickness of the sheet to 0.7 mm, followed by applying a continuous annealing treatment. In continuous annealing treatment, the soaking temperature was set at 730° C. to 850° C., and cooled to about room temperature of 25° C. at a cooling rate of 20° C./sec to 100° C./sec in the case of the samples equal in chemical composition to steel sample No. 3. On the other hand, the soaking temperature was set at 800° C. to 915° C., and the cooling rate was set at 5° C./sec to 30° C./sec in the case of the samples equal in chemical composition to steel sample No. 9.

After the continuous annealing treatment, galvanizing was applied to each of the steel samples. The galvanizing temperature was set at 450° C., and the alloying treatment was carried out at 550° C. Finally, a temper rolling was applied to the annealed sheet at an elongation of 0.8%, so as to obtain steel samples.

The mechanical test and the dent resistance test were applied to the resultant steel samples as in Example 1, with the results as shown in Table 3. Steel samples Nos. 1, 2, 7, 8, 15 and 16 shown in Table 3 represent comparative examples, with steel samples Nos. 3 to 6 and Nos. 9 to 14 representing the present invention.

The annealing temperature for each of comparative examples Nos. 1 and 2 was lower than the lower limit of the range specified in the present invention. As a result, the yield point (YP) was high and the panel shapeability was poor in these comparative examples. The cooling rate for each of comparative examples Nos. 7 and 8 was higher than the upper limit of the range specified in the present invention. As a result, the 2% BH was high, the panel shapeability, and the resistance to the natural aging was poor in these comparative examples. Further, the annealing temperature for each of comparative examples Nos. 15 and 16 did not fall within the range specified in the present invention. As a result, each of YP and 2% BH was somewhat high, and panel shapeability and the resistance to the natural aging was not satisfactory in these comparative examples, though the dent resistance was satisfactory.

On the other hand, any of steel samples Nos. 3 to 6 and 9 to 14 of the present invention was found to be satisfactory in each of the dent resistance, the panel shapeability, and the resistance to the natural aging.

TABLE 3

| Sample | Steel No. | Annealing method | Annealing temperature (° C.) | Cooling rate (° C./sec) | YP MPa) | 2% BH (MPa) | δ 30 (mm) |
|---|---|---|---|---|---|---|---|
| | | | Mechanical and panel properties | | | | |
| 1 | 3 | CA | 740* | 20 | 245 | 3 | 0.2 (○) |
| 2 | | CG | 730* | 20 | 247 | 5 | 0.2 (○) |
| 3 | | CA | 770 | 20 | 231 | 5 | 0.21 (○) |
| 4 | | CG | 780 | 40 | 230 | 10 | 0.23 (○) |
| 5 | | CA | 830 | 40 | 225 | 12 | 0.2 (○) |
| 6 | | CG | 825 | 60 | 220 | 14 | 0.2 (○) |
| 7 | | CA | 840 | 100* | 230 | 30 | 0.19 (○) |

TABLE 3-continued

| Mechanical and panel properties | | | | | | | |
|---|---|---|---|---|---|---|---|
| 8 | | CG | 850 | 100* | 233 | 33 | 0.18 (○) |
| 9 | 9 | CA | 800 | 15 | 233 | 0 | 0.21 (○) |
| 10 | | CG | 810 | 15 | 232 | 0 | 0.21 (○) |
| 11 | | CA | 830 | 5 | 220 | 0 | 0.25 (○) |
| 12 | | CG | 830 | 15 | 229 | 0 | 0.22 (○) |
| 13 | | CA | 860 | 30 | 220 | 3 | 0.24 (○) |
| 14 | | CG | 855 | 30 | 225 | 3 | 0.22 (○) |
| 15 | | CA | 910* | 20 | 240 | 34 | 0.18 (○) |
| 16 | | CG | 915* | 20 | 247 | 36 | 0.15 (○) |

| Sample | ρ (%) | ΔYPel (%) | Remarks |
|---|---|---|---|
| 1 | 6 (×) | 0 (○) | Comparative example |
| 2 | 6 (×) | 0 (○) | Comparative example |
| 3 | 4 (○) | 0 (○) | Present invention |
| 4 | 4 (○) | 0 (○) | Present invention |
| 5 | 4 (○) | 0 (○) | Present invention |
| 6 | 4 (○) | 0 (○) | Present invention |
| 7 | 8 (×) | 0.6 (×) | Comparative example |
| 8 | 8 (×) | 0.8 (×) | Comparative example |
| 9 | 4 (○) | 0 (○) | Present invention |
| 10 | 4 (○) | 0 (○) | Present invention |
| 11 | 2 (○) | 0 (○) | Present invention |
| 12 | 3 (○) | 0 (○) | Present invention |
| 13 | 2 (○) | 0 (○) | Present invention |
| 14 | 3 (○) | 0 (○) | Present invention |
| 15 | 10 (×) | 0.8 (×) | Comparative example |
| 16 | 11 (×) | 0.9 (×) | Comparative example |

*Outside scope of present invention
CA: Continuous annealing
CG: Continuous galvanizing

What is claimed is:

1. A method of manufacturing a cold rolled steel sheet excellent in its resistance to natural aging and in panel properties, said method comprising steps of:

(a) preparing steel consisting of 0.005 to 0.012% by weight of C., 0.01 to 0.4% by weight of Si, 0.15 to 1.0% by weight of Mn, 0.01 to 0.08% by weight of P, at most 0.02% by weight of S, 0.01 to 0.1% by weight of sol. Al, at most 0.004% by weight of N, and at least one element selected from the group consisting of 0.01 to 0.2% by weight of Nb and 0.04 to 0.1% by weight of Ti, X in formula (1) defined by C., Nb, and Ti contents falling within a range of between 1.2 and 2.5, and the balance of essentially Fe and unavoidable impurities, wherein:

$$X=(12/93)(Nb\%/C\%)+(12/48)(Ti^*\%/C\%) \quad (1)$$

where $Ti^*\%=Ti\%-(48/14)N\%-(48/32)S\%$ when Ti* in the above equation is not larger than 0, Ti* is regarded as 0;

(b) melting the steel;

(c) casting the molten steel;

(d) applying a hot rolling to the cast steel;

(e) applying a cold rolling to the molten steel;

(f) soaking the cold rolled steel sheet at T(° C.) meeting a formula $$Ac3 \geqq T(^\circ C.) \geqq 157\log(X)+737;$$

and (g) cooling the steel sheet after the soaking step at a cooling rate meeting a formula $$R(^\circ C./sec) \leqq -35+162/X.$$

2. The method according to claim 1, wherein the steel further contains 0.0002 to 0.002% by weight of B.

3. The method according to claim 1, wherein the cold rolled steel has a yield point of 212 to 233 MPa, a 2% BH, i.e., degree of hardening achieved by baking after impartation of 2% strain, of 0 to 11 MPa, a residual depression 30 after application and, then, removal of 30 kgf of load of 0.18 to 0.25 mm, a spring back amount of 1 to 4%, and a restoration amount of yield point elongation ΔYPel after storage for 6 months at 25° C. of 0%.

4. The method according to claim 2, wherein the cold rolled steel has a yield point of 212 to 233 MPa, a 2% BH, i.e., degree of hardening achieved by baking after impartation of 2% strain, of 0 to 11 MPa, a residual depression 30 after application and, then, removal of 30 kgf of load of 0.18 to 0.25 mm, a spring back amount of 1 to 4%, and a restoration amount of yield point elongation ΔYPel after storage for 6 months at 25° C. of 0%.

5. The method according to claim 1, wherein the cold rolled steel has a yield point of 220 to 231 MPa, a 2% BH, i.e., degree of hardening achieved by baking after impartation of 2% strain, of 5 to 14 MPa, a residual depression 30 after application and, then, removal of 30 kgf of load of 0.2 to 0.23 mm, a spring back amount of 4%, and a restoration amount of yield point elongation ΔYPel after storage for 6 months at 25° C. of 0%.

6. The method according to claim 2, wherein the cold rolled steel has a yield point of 220 to 231 MPa, a 2% BH, i.e., degree of hardening achieved by baking after impartation of 2% strain, of 5 to 14 MPa, a residual depression 30 after application and, then, removal of 30 kgf of load of 0.2 to 0.23 mm, a spring back amount of 4%, and a restoration amount of yield point elongation ΔYPel after storage for 6 months at 25° C. of 0%.

7. The method according to claim 1, wherein the cold rolled steel has a yield point of 220 to 233 MPa, a 2% BH, i.e., degree of hardening achieved by baking after impartation of 2% strain, of 0 to 3 MPa, a residual depression 30 after application and, then, removal of 30 kgf of load of 0.21 to 0.25 mm, a spring back amount of 2 to 4%, and a restoration amount of yield point elongation ΔYPel after storage for 6 months at 25° C. of 0%.

8. The method according to claim 2, wherein the cold rolled steel has a yield point of 220 to 233 MPa, a 2% BH, i.e., degree of hardening achieved by baking after impartation of 2% strain, of 0 to 3 MPa, a residual depression 30 after application and, then, removal of 30 kgf of load of 0.21 to 0.25 mm, a spring back amount of 2 to 4%, and a restoration amount of yield point elongation ΔYPel after storage for 6 months at 25° C. of 0%.

9. The method according to claim 1 for manufacturing a hot-dip zinc coated steel sheet being excellent in resistance to natural aging and in panel properties, further comprising the step of galvanizing the cold rolled steel sheet.

10. The method according to claim 2 for manufacturing a hot-dip zinc coated steel sheet being excellent in resistance to natural aging and in panel properties, further comprising the step of galvanizing the cold rolled steel sheet.

11. The method according to claim 3 for manufacturing a hot-dip zinc coated steel sheet being excellent in resistance to natural aging and in panel properties, further comprising the step of galvanizing the cold rolled steel sheet.

12. The method according to claim 5 for manufacturing a hot-dip zinc coated steel sheet being excellent in resistance to natural aging and in panel properties, further comprising the step of galvanizing the cold rolled steel sheet.

13. The method according to claim 7 for manufacturing a hot-dip zinc coated steel sheet being excellent in resistance to natural aging and in panel properties, further comprising the step of galvanizing the cold rolled steel sheet.

* * * * *